US010695732B2

(12) United States Patent
Syed

(10) Patent No.: US 10,695,732 B2
(45) Date of Patent: Jun. 30, 2020

(54) MIXING SILO DESIGN FOR DUST REMOVAL AND METHODS OF USING THE SAME

(71) Applicant: SABIC Global Technologies B.V., Bergen op Zoom (NL)

(72) Inventor: Tariq Syed, Riyadh (SA)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 123 days.

(21) Appl. No.: 15/759,238

(22) PCT Filed: Sep. 9, 2016

(86) PCT No.: PCT/IB2016/055394

§ 371 (c)(1),
(2) Date: Mar. 12, 2018

(87) PCT Pub. No.: WO2017/042736

PCT Pub. Date: Mar. 16, 2017

(65) Prior Publication Data

US 2018/0236422 A1 Aug. 23, 2018

Related U.S. Application Data

(60) Provisional application No. 62/216,441, filed on Sep. 10, 2015.

(51) Int. Cl.
*B01F 15/00* (2006.01)
*B01F 5/00* (2006.01)
(Continued)

(52) U.S. Cl.
CPC ..... *B01F 15/00987* (2013.01); *B01F 5/0065* (2013.01); *B01F 13/0211* (2013.01);
(Continued)

(58) Field of Classification Search
CPC ..... B01F 5/0065; B01F 15/00987; B01F 5/00987; B01F 13/0211; B01F 13/0261;
(Continued)

(56) References Cited

U.S. PATENT DOCUMENTS 4,002,323 A * 1/1977 Grun ..... B01F 7/163 366/102
2007/0278018 A1* 12/2007 Hanaoka ..... B01F 5/246 177/105

FOREIGN PATENT DOCUMENTS

CN 101874994 A 11/2010
CN 201745096 U 2/2011
(Continued)

OTHER PUBLICATIONS

International Preliminary Report on Patentability and Written Opinion of the International Searching Authority; International Application No. PCT/IB2016/055394; International Filing Date—Sep. 9, 2016; dated Mar. 13, 2018; 7 pages.
(Continued)

*Primary Examiner* — Anshu Bhatia
(74) *Attorney, Agent, or Firm* — Cantor Colburn LLP

(57) ABSTRACT

An apparatus and methods of mixing materials in a silo that includes a mixing chamber (2) with an outlet (23) the bottom and an inlet hose (4) connected to an inlet opening at the top; a sieve (16) at the top of the mixing chamber above the inlet opening and below the outlet opening to prevent contact between a particulate mixing material and the top of the mixing chamber and to allow dust through; a pump system (18) to create a negative pressure region at the top of the mixing chamber; and an air manifold assembly (8), which includes an air pressure manifold (10) having an air nozzle (12) to introduce an air stream into the mixing chamber and an air manifold cover (14) to prevent contact between the
(Continued)

particulate mixing material and the air pressure manifold, and to allow a particulate mixed product material to pass to the mixing chamber outlet.

18 Claims, 2 Drawing Sheets

(51) Int. Cl.

| | |
|---|---|
| ***B01F 13/02*** | (2006.01) |
| ***B01F 15/02*** | (2006.01) |
| ***B07B 7/06*** | (2006.01) |
| ***B08B 15/00*** | (2006.01) |
| ***B08B 17/02*** | (2006.01) |

(52) U.S. Cl.
CPC ..... *B01F 13/0261* (2013.01); *B01F 13/0283* (2013.01); *B01F 15/00194* (2013.01); *B01F 15/0292* (2013.01); *B07B 7/06* (2013.01); *B08B 15/00* (2013.01); *B08B 15/002* (2013.01); *B08B 17/02* (2013.01); *B01F 2215/0422* (2013.01)

(58) Field of Classification Search
CPC ..... B01F 13/0283; B01F 15/00194; B01F 15/0292; B01F 2215/0422; B07B 7/06; B08B 15/00; B08B 15/002; B08B 17/02
See application file for complete search history.

(56) References Cited

FOREIGN PATENT DOCUMENTS

| | | | |
|---|---|---|---|
| CN | 202376870 | U | 8/2012 |
| CN | 203439282 | U | 2/2014 |
| DE | 10308722 | A1 | 9/2004 |
| EP | 0997184 | A1 | 10/1998 |
| EP | 2447047 | A1 | 5/2012 |
| JP | 2005104076 | A | 4/2005 |
| SU | 1586764 | A1 | 3/1986 |
| WO | 2015059943 | A1 | 10/2013 |

OTHER PUBLICATIONS

International Search Report for International Application No. PCT/IB2016/055394; Date of Completion: Jan. 2, 2017; dated Jan. 11, 2017; 3 Pages.

Written Opinion for International Application No. PCT/IB2016/055394; International Filing Date: Sep. 9, 2016; Priority Date: Sep. 10, 2015; 6 Pages.

* cited by examiner

MIXING SILO DESIGN FOR DUST REMOVAL AND METHODS OF USING THE SAME

CROSS REFERENCE TO RELATED APPLICATIONS

This application is a 371 of International Application No. PCT/IB2016/055394 filed Sep. 9, 2016, which claims the benefit of Provisional Application No. 62/216,441, filed Sep. 10, 2015, both of which are incorporated by reference in their entirety herein.

BACKGROUND

The present disclosure relates to apparatus and methods for mixing materials in a silo, in particular bulk particulate materials.

Many industries require large quantities of bulk particulate material that which is mixed or homogenized prior to use. Mixing of large quantities of bulk particulate materials can be done in mixing silos, also known as blending silos or homogenizing silos. For convenience herein, "mixing" is inclusive of blending, homogenizing, and the like. In mixing silos, raw materials to be mixed are fed into the silo and mixed by rotational moving parts, for example by pipe blenders, augers, or screw mixers. These mechanisms can achieve intensive intermixing of the bulk particulate materials to produce a mixed bulk product material. Dust can be present in the bulk particulate materials, or created during the mixing, for example by friction between the particulate materials and the moving parts. As used herein, "dust" includes any particulate matter having a size smaller than the desired particle size of the mixed bulk product as described in further detail below. Dust in the mixed bulk product material can render the product unacceptable for some uses.

Thus, there is a need for a mixing silo design and method of use to reduce or eliminate dust content from the material mixed therein.

SUMMARY

Disclosed herein, in various embodiments, are apparatus and methods of mixing materials in a silo.

In some embodiments the mixing silo comprises a mixing chamber having a top and a bottom, and a mixing chamber outlet located at the bottom of the mixing chamber; an inlet hose connected to an inlet opening, located towards the top of the mixing chamber; an outlet hose connected to an outlet opening, located towards the top of the mixing chamber at a point above the inlet hose and inlet opening; a sieve located towards the top of the mixing chamber, disposed above the inlet opening and below the outlet opening, configured to prevent contact between a particulate mixing material and the top of the mixing chamber and to allow dust therethrough; a pump system operably connected to the mixing chamber, configured to create a negative pressure region at the top of the mixing chamber and pull dust through the sieve and remove the sieved dust from the top of the mixing chamber via the outlet opening; and an air manifold assembly, located in the mixing chamber towards the bottom. The air manifold assembly can include an air pressure manifold comprising an air nozzle to introduce an air stream into the mixing chamber, and an air manifold cover configured to allow an air stream into the mixing chamber, to prevent contact between the particulate mixing material and the air pressure manifold, and to allow a particulate mixed product material to pass to the mixing chamber outlet.

In some embodiments the process for mixing a particulate mixing material in a mixing silo, the process comprising introducing the particulate mixing material into a mixing chamber, the mixing chamber including a top and a bottom, and a mixing chamber outlet located at the bottom of the mixing chamber; introducing an air stream into the mixing chamber to mix the particulate mixing material, wherein the introducing is via an air manifold assembly located towards the bottom of the mixing chamber, creating a negative pressure region at the top of the mixing chamber to pull dust into the negative pressure region, wherein the dust passes through a sieve located at the top of the mixing chamber and the sieve is configured to allow the dust to pass but not the particulate mixing material; removing the dust from the silo; and allowing the mixed product material to accumulate in the mixing chamber outlet. The air pressure manifold can include a nozzle and an air manifold cover, configured to allow the air stream into the mixing chamber, to prevent contact between the particulate mixing material and contacting the air pressure manifold, and to allow a particulate mixed product material to pass to the mixing chamber outlet.

These and other features and characteristics are more particularly described below.

BRIEF DESCRIPTION OF THE DRAWINGS

The following is a brief description of the drawings, wherein like elements are numbered alike and which are presented for purposes of illustrating the exemplary embodiments disclosed herein and not for purposes of limiting the same.

DETAILED DESCRIPTION

Figure 1:
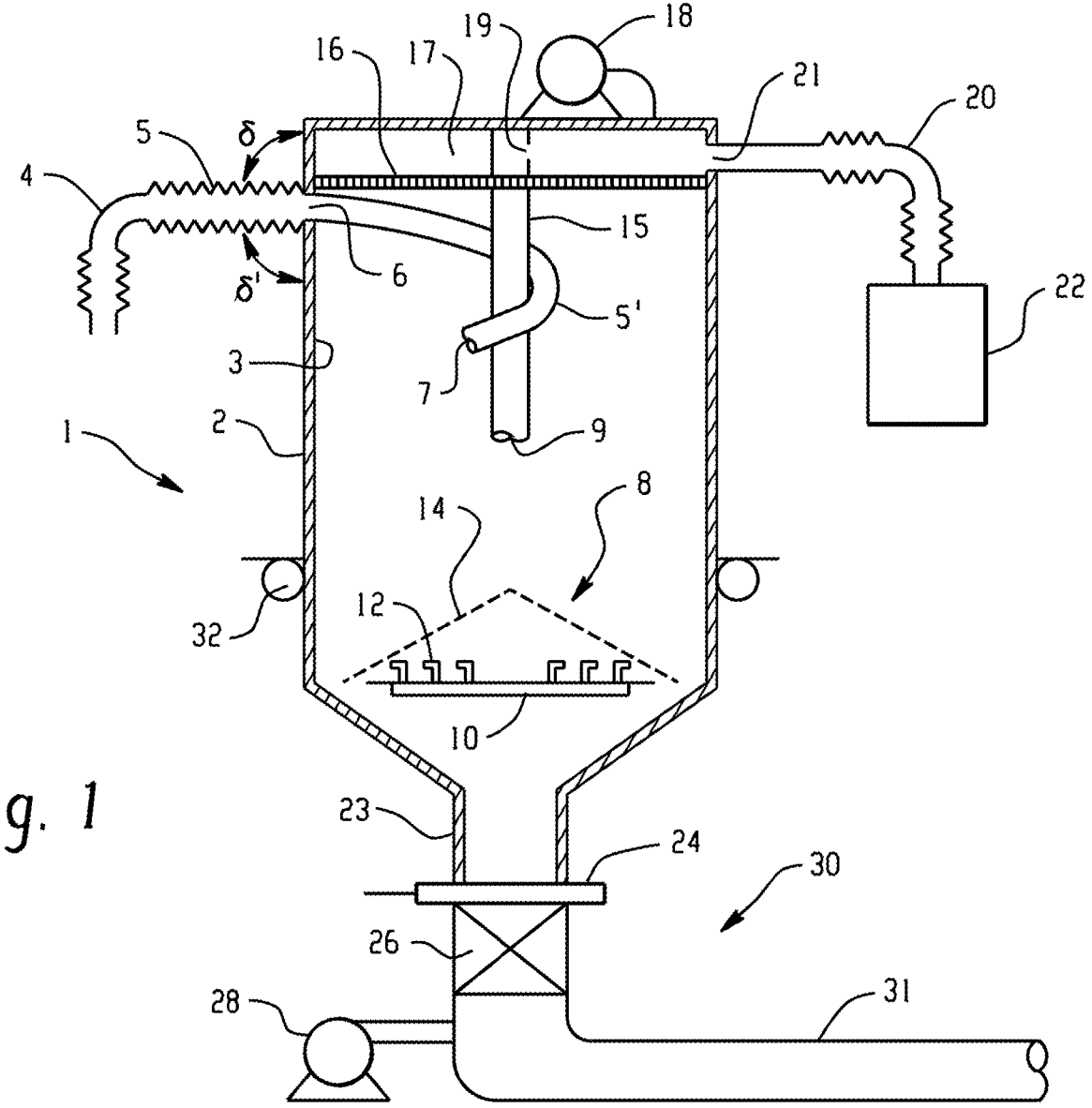
FIG. 1 is a schematic drawing of some embodiments of a mixing silo disclosed herein including a dust removal system.

Disclosed herein are apparatus and methods relating to mixing silo design, processes for mixing materials in a mixing silo, and processes for reducing or removing dust from mixing material therein. Dust in bulk mixing material can come from various sources, including the raw material feed itself into the silo, particulates being crushed during the mixing process, or metal other material dust from friction between the moving parts of mixing silo. A mixing silo design and process that minimizes dust creation in the mixing materials during the mixing process, and also removes dust from the mixing material is disclosed herein.

In some embodiments, a mixing silo can include a mixing chamber into which a particulate mixing material is fed. The mixing material is in the form of particles, and can be of any regular or irregular shape, for example pellets, flakes, chips, granules, and the like. The mixing chamber can be any suitable size and shape for the material to be mixed. For example, a mixing chamber can include a cylindrical shape, a conical shape, or a combination including at least one of the foregoing. A mixing silo can include an air manifold assembly, located generally towards the bottom of the mixing chamber, to aid in mixing the material, and a pump system attached to the top of the mixing chamber, to aid in the removal of dust. A mixing silo can further include a silo outlet including a slide gate and a silo outlet pipe, to allow mixing material to be retained within the mixing chamber during mixing, and to allow mixed product material to be released from the mixing chamber when mixing is complete.

Mixing material can be fed into the mixing chamber at any point along the height of the mixing chamber, or generally towards the top of the mixing chamber. The mixing material can be fed into the mixing chamber via an inlet hose in operable communication with the mixing chamber. Optionally, the inlet hose can be in direct communication with an inlet opening in the side of the mixing chamber at an angle to the chamber without extending into the mixing chamber. The inlet hose can be flexibly connected to allow adjustment of the angle. In some embodiments, the inlet hose can be in operable communication with the inlet opening at an angle such that as the mixing material enters the mixing chamber it creates a vortex phenomenon. Without being bound by theory, the vortex phenomenon can create mixing similar to that of a centrifuge within the mixing chamber and separate lighter particles from heavier particles. In other embodiments, the inlet hose can extend through an inlet opening in the side of the mixing chamber and into the mixing chamber at a second angle. The inlet hose extending into the mixing chamber can be configured in a downward fashion to create the vortex phenomenon. In some embodiments the inlet hose extending into the mixing chamber can be configured in a downward, spiral fashion such that as mixing material enters the mixing chamber via the inlet hose, the mixing material can flow in a similar spiral-like fashion, thereby creating the vortex phenomenon. A mixing material flow as described can partially mix the mixing material as it initially enters the mixing chamber and separate lighter particles from heavier particles.

In some embodiments a mixing silo can include an air manifold assembly. An air manifold assembly can direct an air jet stream or a plurality of air jet streams into the mixing chamber. An air jet stream can thereby further homogenize the mixing material after the mixing material has entered the mixing chamber. Further, the air manifold assembly can enable the removal of dust from the mixing material. An air manifold assembly can be located at any height within the mixing chamber along the vertical axis, generally towards the bottom. The air manifold assembly can be connected or attached to the inside of the mixing chamber via an attachment mechanism. An air jet stream can be introduced into the mixing chamber in any direction or angle, generally in an upward direction. In some embodiments where one or more air jet streams are introduced into the mixing chamber, each air jet stream can be introduced into the mixing chamber independently of any other air jet stream, or each air jet stream can be introduced into the mixing chamber in the same direction or in different directions.

As mixing material is fed into the mixing silo and mixed by vortex mixing, air jet stream mixing, or a combination including at least one of the foregoing, a pump system in operable communication with the mixing chamber can be employed for the removal of dust. The pump system can include a vacuum pump, an outward blower, for example a fan, or a combination including at least one of the foregoing. The pump system can create suction, or a negative pressure region, towards the top of the mixing chamber to pull dust towards the top of the mixing chamber. An outlet hose can be in operable communication with an outlet opening in the mixing chamber. An outward blower can blow the dust through the outlet opening into the outlet hose to effectively remove it to a dust collection unit or suitable alternative.

In operation, the pump system can work in conjunction with a sieve located towards the top of the mixing chamber. The sieve can be disposed between the inlet opening and the outlet opening, and can be configured to prevent mixing material from contacting the top of the mixing chamber, while allowing sieved material therethrough, where the sieved material includes dust to be removed. The sieve can be configured based upon a particular mixing material being mixed in the mixing silo such that the sieve allows passage of the particles which are smaller than those desired in the mixed product material while retaining the mixing material itself within the mixing chamber. An advantageous feature of this system is that the desired lowest particle size of the mixed product material can be adjusted by adjusting the size of the openings in the sieve.

After the mixing material has been suitably mixed and the dust has been suitably removed, the mixed product material can be removed from the mixing chamber by a release mechanism such as a slide gate located at the bottom of the mixing chamber. Optionally a pump or a series of pumps can aid removal of the mixed product material via a silo outlet pipe.

In a process for mixing a bulk material, a particulate mixing material can be introduced into the mixing silo, for example towards the top of a mixing chamber. The introducing can be via the inlet hose in operable communication with the inlet opening. In some embodiments the inlet hose can be in operable communication with the inlet opening at an angle such that as the mixing material enters the mixing chamber it creates a vortex phenomenon that mixes the mixing material and separates lighter particles from heavier particles. Air, in particular controlled pressurized air, can be introduced into the mixing silo via an air manifold assembly located inside and towards the bottom of the mixing chamber. The air manifold assembly includes an air manifold and an air manifold cover. An air stream can emanate from an air pressure manifold via a nozzle on the manifold, pass through the air manifold cover, and into the mixing chamber to further mix the mixing material. The air manifold cover can include a plurality of holes smaller than individual mixing material particles to prevent clogging the nozzles of the air pressure manifold. A negative pressure can be established at the top of the mixing chamber to pull dust from the mixing material during mixing. The negative pressure can be established by a pump system, including a vacuum pump, an outward blower, or a combination including at least one of the foregoing in operable communication with the mixing chamber. As the dust is pulled to the top of the mixing chamber it can pass through a sieve that can be located towards the top of the mixing chamber. The sieve can be configured to stop the mixing material from contacting the top of the mixing chamber while at the same time allowing dust through. Subsequent to mixing and dust removal, the mixed product material can be allowed to accumulate in the bottom of the mixing chamber adjacent a mixing chamber outlet. Any one or more aspects of the process can be performed batch-wise or continuously. In an embodiment, the dust is removed from the mixing material continuously throughout the process.

A more complete understanding of the components, processes, and apparatuses disclosed herein can be obtained by reference to the accompanying drawings. These figures (referred to herein as "FIG.") are merely schematic representations based on convenience and ease of demonstrating the present disclosure, and are therefore not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

FIG. 1 illustrates an embodiment of a mixing silo 1 for the mixing of particulate mixing material and for dust removal as disclosed herein. The mixing material can include dust, for example any matter having at least one dimension smaller than the desired smallest dimension of the mixed product material. In some embodiments the dust can have at least one dimension that is at least 20% smaller than the desired smallest dimension of the mixed product material. In some embodiments the dust can have at least one dimension that is at least 50% smaller than the desired smallest dimension of the mixed product material. Alternatively, the dust can have a particle volume that is at least 20% smaller than the desired smallest particle volume of the mixed product material. In some embodiments the dust can have a particle volume that is at least 50% smaller than the desired smallest dimension of the mixed product material. Alternatively, the dust can have a particle weight that is at least 20% smaller than the desired smallest particle weight of the mixed product material. In some embodiments the dust can have a particle weight that is at least 50% smaller than the desired smallest particle weight of the mixed product material.

Particulate mixing material can be fed into the mixing chamber 2 via an inlet hose 4, which can be stiff, flexible, or both. For example, the inlet hose 4 can include a flexible segment 5 or 5'. The hose can be of any effective cross-sectional shape or length, and can vary in stiffness or dimension along its length. The inlet hose 4 can be connected to an inlet opening 6 towards the top of the mixing silo 1 and can optionally be configured to not extend into mixing chamber 2 (not shown). The flexible segment 5 can allow the inlet hose 4 to be moveably connected to the mixing chamber 2 such that the inlet hose 4 at opening 6 is at an upward angle δ or a downward angle δ' of more than 0° to 90° relative to the inside wall 3 that houses opening 6. In some embodiments the inlet hose 4 at opening 6 is at an angle δ or δ' of 10° to 80°, or an angle δ or δ' of 25° to 75°, or an angle δ or δ' of 35° to 55°. In some embodiments the angle δ is 35° to 55°, or 45°. The angular configuration of the inlet hose 4 at inlet opening 6 can allow the particulate mixing material to be fed into the mixing chamber 2 to create a mixing flow of the material into chamber 2. For example, when the angle δ is 35° to 55°, or 45°, a vortex flow into the mixing chamber 2. Without being bound by theory, this vortex flow can create centrifuge-type mixing of the mixing material upon entry to mixing chamber 2, which also aids in separating light particles from heavy particles.

Alternatively, and as shown in FIG. 1, the inlet hose 4 can optionally extend through the inlet opening 6 and into mixing chamber 2. The inlet hose 4 further includes an outlet 7, and has any suitable length or configuration. In some embodiments, the inlet hose 4 includes a flexible segment 5' extended into the mixing chamber 2 configured to provide a mixing flow of particulate mixing material into the mixing chamber 2. For example, the outlet 7 of inlet hose 4 can be angled downwards as shown. In some embodiments the inlet hose 4 extended into mixing chamber 2 can be configured downwards in a spiral to provide a vortex flow of particulate mixing material into mixing chamber 2, which separates lighter particles and heavier particles.

The mixing silo 1 includes an air manifold assembly 8 located towards the bottom of the mixing chamber 2. For example the air manifold assembly 8 can be attached to the mixing chamber 2 by one or more air manifold supports. The air manifold assembly can be configured to enhance the mixing process without mechanical mixing of the particulate mixing material. The air manifold assembly 8 includes an air pressure manifold 10, air nozzle(s) 12, and an air manifold cover 14. The air manifold cover 14 can have a plurality of holes in it that are smaller than the individual particles of the mixing material, and can thereby be configured to prevent particles of the mixing material from contacting the air pressure manifold 10, or clogging the nozzle(s) 12. As mixing material is fed into the mixing chamber 2, the nozzle(s) 12 of the air pressure manifold 10 can blow an air stream, for example a pressurized air stream upward into the mixing chamber 2 that can push the dust upward. The air nozzle(s) 12 can be in the form of an opening on the manifold or a protrusion from the manifold including an opening as shown in FIG. 1. In some embodiments a plurality of nozzles 12 can be used. The nozzles 12 of the air pressure manifold 10 can operate independently from one another. For example each nozzle can be oriented differently, blow air at different velocities, at low or high pressure, or at different times. For example, some nozzles 12 can be on at any given moment and others can be off. A control system can be utilized to control the orientation and operation of the nozzles 12 and thus control the air streams. Alternatively, the nozzles can be configured to randomize the air streams, or be controlled to randomize the air streams when desired.

The mixing chamber 2 can include a sieve 16, attached to the inner walls of the mixing chamber 2 towards the top of the mixing chamber 2, above the inlet opening 6 and below the outlet opening 21. The sieve 16 can include metal strips and/or bars to enhance its structural integrity, and can further include a mesh or screen. The openings in the sieve 16 can be smaller than the dimensions of the particles of mixing material such that the sieve 16 prevents individual particles of mixing material from contacting the top of the mixing chamber 2, while allowing the dust through as sieved material.

In the area of the mixing chamber 2 above the sieve 16, a negative pressure region 17 can be created. The negative pressure region 17 can be created using a pump system 18, specifically a vacuum pump, an outward blower, or both. The pump system 18 can be located or attached to the top of the mixing chamber 2 as shown. The pump system 18 can create a vacuum that draws the dust through the sieve 16 and can direct (e.g., by blowing) the sieved material into an outlet hose 20 attached at an outlet opening 21. The outlet hose 20 can be solid, semi-flexible, or flexible. The dust can then be directed through the outlet hose 20, and into a dust collection unit 22. The pump system 18 can be adjusted or controlled to optimize the negative pressure region 17 and the flow of the dust through the sieve 16 and into the outlet hose 20.

In some embodiments, the mixing chamber 2 can optionally include a dust pipe 15 that can be located at the top of the mixing chamber 2 and extend downwards through the sieve 16 and into the mixing chamber 2. The dust pipe 15 can include a dust pipe inlet 9 located below the sieve 16 and a dust pipe outlet 19 at a point on the dust pipe 15 above the sieve 16. The dust pipe 15 can support a portion of the inlet hose 4 inside the mixing chamber 2, for example, when the portion of the inlet hose 4 inside the mixing chamber 2 is in a spiral configuration. The dust pipe 15 can be at any effective angle relative to the plane of the sieve 16, depending on the design of the air flow. In some embodiments the dust pipe 15 can be at an angle of 90° to the plane of sieve 16. The dust pipe 15 can optionally have a sieve member 16 located within the pipe to prevent particles of the mixing material from being pulled into negative pressure region 17. The sieve member 16 can be integral to sieve 6 or a separate sieve. When separate, the sieve member 16 can be located anywhere within the length of the dust pipe 15 in front of dust pipe outlet 19.

The pump system 18 can pull dust from the middle and lower areas of the mixing chamber 2 into the dust pipe 15. In these embodiments a vacuum pump can be used to create the negative pressure region 17, wherein the negative pressure region 17 can be a controlled negative pressure region. The dust can travel up through the dust pipe 15, and through a portion of an optional sieve member located inside the dust pipe 15 (not shown). The optional sieve member the openings in the optional sieve member can be smaller than the dimensions of the particles of mixing material such that it prevents individual particles of mixing material from passing through dust pipe 15 while allowing the dust through as sieved material. Alternatively, the pump system 18 can include an outward blower that can pull the dust through the dust pipe outlet 19, through the outlet opening 21. The dust can then be directed through the outlet hose 20, and into a dust collection unit 22. In other embodiments, pump system 18 can includes both a vacuum pump and an outward blower. Optionally, the pump system 18 can be adjusted to optimize the negative pressure region 17 and the flow of the dust up into and through the dust pipe 15, through the sieve 16, out the dust pipe opening 19, and into the outlet hose 20.

The mixing silo 1 can further include a silo outlet 30. A silo outlet 30 can include the mixing chamber outlet 23, and a release mechanism 24 for the mixed product material collected at the mixing chamber outlet 23. For example, the release mechanism can be located between mixing chamber outlet 23 and a silo outlet pipe 31. The release mechanism 24 can be kept closed during the mixing process. Once the mixing process is completed to the desired degree, the release mechanism 24 can be opened to allow the mixed product material out of the mixing chamber 2 via the mixing chamber outlet 23. The release mechanism 24 can be, for example, a slide gate. Movement of the mixed product material through the silo outlet 30 can be by gravity alone, or assisted. For example, a rotary pump 26 can be employed to assist in removing the mixing material from the mixing chamber outlet 23, or a conveying pump 28 can be employed to move the mixed product material through the silo outlet pipe 31, or both can be used. In an example, the rotary pump 26 can be used in combination with the conveying pump 28 to prevent clogging the silo outlet pipe 31.

The mixing silo 1 can include one or more load cells 32 to monitor and realize the amount, density, or both of the mixing material in the mixing chamber 2, and in turn be employed in conjunction with an external control system to optimize the mixing and dust removal conditions within the mixing chamber 2.

Figure 2:
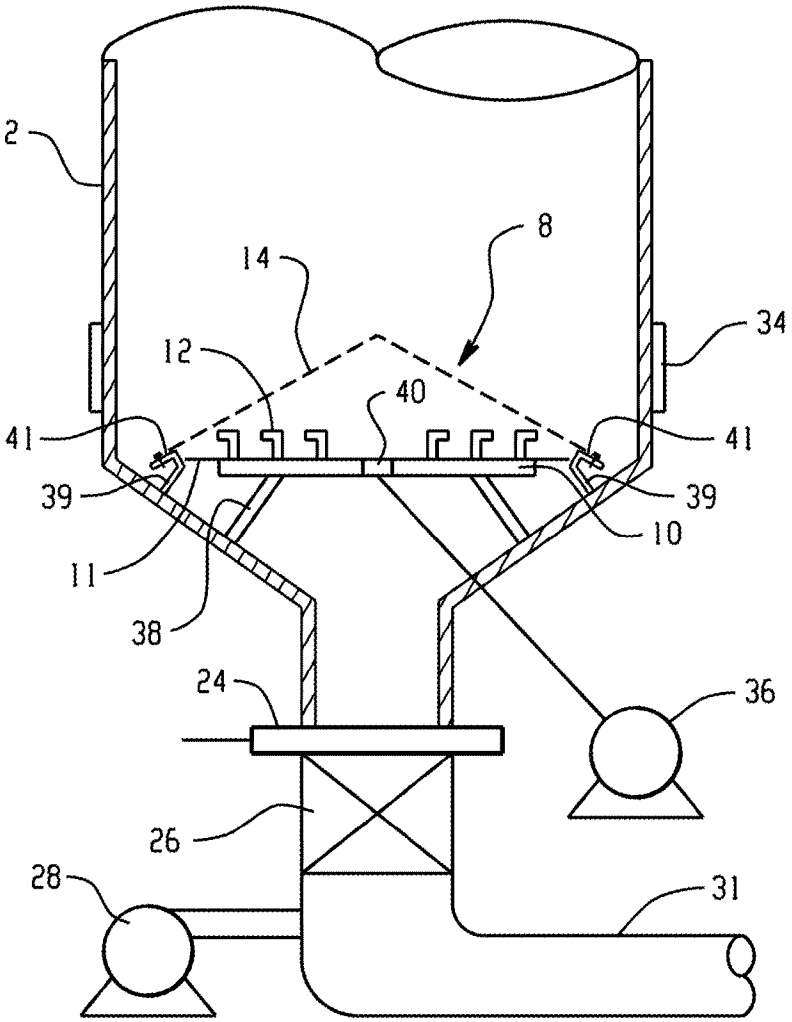
FIG. 2 is a schematic drawing of some embodiments of a mixing silo disclosed herein and including air mixing blades.

Turning now to FIG. 2, some embodiments of the mixing silo disclosed herein are illustrated. The air pressure manifold 10 can further include a blade rotation mechanism 40, which can be operated by a blade spinning motor 36. The blade rotation mechanism 40 can include a ball bearing, gear assembly, and shaft system, or effective alternative, configured to allow the air blade(s) 11 to rotate. The blade spinning motor 36 can be an electrical or pneumatic mechanism, or suitable alternative. The blade rotation mechanism 40 and blade spinning motor 36 can operate to rotate the air pressure manifold 10 to manipulate the air stream(s) blowing upward into the mixing chamber 2, and can thereby enhance the mixing of the mixing material without adding a mechanical mixing element that contacts the particulate mixing material.

The air manifold cover 14 can be positioned above the air pressure manifold 10 and include a plurality of holes or openings which can be smaller than the dimensions of the particulate mixing material. The air manifold cover 14 can be configured to prevent individual particles of mixing material from contacting the air pressure manifold 10 or clogging the nozzle(s) 12. The air manifold cover 14 can be attached to the inside of the mixing chamber 2 by a plurality of fastening studs 39, specifically greater than or equal to four studs, more specifically greater than or equal to eight studs. A fastening stud 39 can be attached to the inside of the mixing chamber 2 in any suitable manner towards the bottom of the mixing chamber 2. A stud can include a stud head 41 that can be configured to match the angle of the air manifold cover 14. The air manifold cover 14 can be removably attached to a stud head 41 by any suitable fastener, for example by a screw, snap, or any known attachment mechanism. Alternatively, the air manifold cover 14 can be attached to the inside of the mixing chamber 2 by any alternative effective attachments. The air manifold cover 14 can be detached, for example during repair or replacement. The air manifold cover 14 can include metal strips and/or bars to enhance its structural integrity, and further include a mesh or screen, which can be made from any material, such as thick wire. The air manifold cover 14 can be cone-shaped, having an internal angle of 35° to 75°, specifically an angle of 45° to 65°, more specifically an angle of 60°. The air manifold cover 14 can be configured such that the particulate mixing material can effectively fall past the air manifold assembly 8 and be deposited at the bottom of the mixing chamber 2, and then released from the mixing chamber 2 when mixing is completed.

The mixing silo 1 can further include one or more silo side doors 34 for access to the inside of mixing chamber 2, for example for maintenance, cleaning, or troubleshooting of the apparatus or process. A silo side door 34 can be located on any suitable point along the circumference and height of the mixing chamber 2. For example, a silo side door 34 can be located towards the bottom of the mixing chamber 2 to allow access to the air manifold assembly 8 area, a silo side door 34 can be located towards the top of the mixing chamber 2 to allow access to the sieve 16 and dust pipe 15 area, or both. The mixing silo 1 can include additional silo side doors 34 at any point access is needed.

Figure 3:
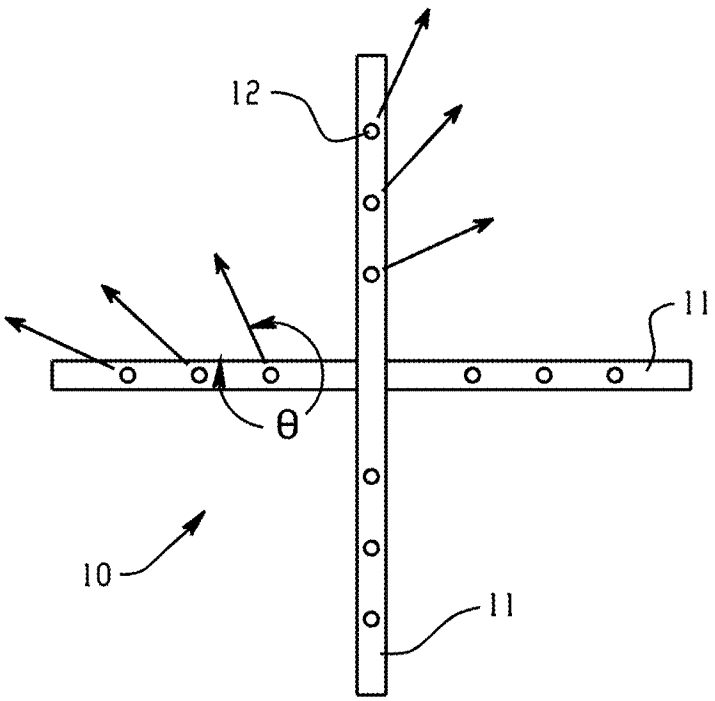
FIG. 3 is a schematic drawing overhead view of some embodiments of an air pressure manifold disclosed herein.
Figure 4:
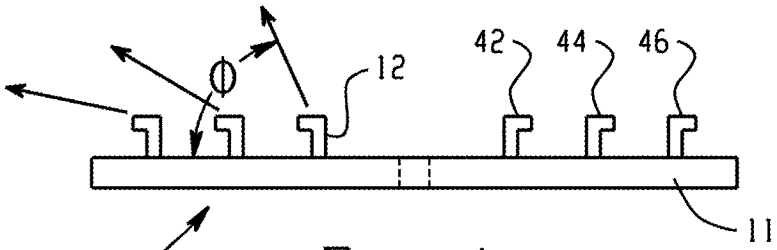
FIG. 4 is a schematic drawing side view of some embodiments of an air pressure manifold disclosed herein.

FIG. 3 and FIG. 4 illustrate further embodiments of the air pressure manifold 10 integrated into air blade(s) 11. An air blade 11 can include one or a plurality of nozzles 12 as described above, distributed in any manner across the entirety of the air blade 11, for example the nozzles 12 can be distributed evenly across the air blade 11, or they can be grouped. In some embodiments, the nozzles 12 are distributed as two groups, one on either side of an air blade 11, wherein the center of an air blade 11 is over the blade rotation mechanism 40. A group, for example, can include three air nozzles: an inner nozzle 42, a middle nozzle 44, and an outer nozzle 46. The nozzles 12 of the air pressure manifold 10 can be adjusted at an angle $\theta$ from 0° to 360°, or at an angle $\varphi$ from 0° to 90°, or both, so as to optimize the air streams entering the mixing chamber 2. In some embodiments, the inner nozzle 42 can be adjusted to an angle φ of 60°, the middle nozzle 44 can be adjusted to an angle φ of 45°, and the outer nozzle 46 can be adjusted to an angle φ of 30°. It is to be understood that although the description of the nozzle, various nozzle groupings, and angles is in the context of movable air blades 11, the description also applies to a fixed air manifold 10.

As stated above, the nozzles 12 can operate independently and direct air streams of high or low pressure and varying velocities into the mixing chamber 2. By varying one or more of the air pressures, air velocities, and flow times of the air streams, the mixing of the mixing material can be enhanced. External control mechanisms can control the air streams emanating from the nozzles 12 into the mixing chamber 2 in a pattern or in a random fashion. Control of the nozzles 12, and thus the air streams, can be material dependent. For example, if the mixing chamber 2 is half-full of mixing material, different air pressure and velocity from the nozzles 12 can be used than if the mixing chamber 2 is a quarter-full of mixing material. The amount of mixing material, the type of mixing material, the shape of the particulates, and the density of the mixing material can all be considered when determining the air stream flow into the mixing chamber 2. In determining the air stream flow into the mixing chamber 2, the mixing silo 1 can further include load cells 32 as part of a control system. Thus the air stream flow into the mixing chamber 2 can be based on the total amount of mixing material, as well as the shape of the particulates, type, and density of the mixing material. By utilizing control mechanisms and air stream sequencing and optimization, stagnant zones within the mixing chamber 2 can be reduced or prevented.

Embodiments of the mixing silo disclosed herein utilize centrifuge-like action, air jet streams, and negative pressure systems to achieve mixing of mixing material and at the same time removal or reduction of dust in mixing material. Thus, as opposed to other mechanically mixed mixing silos, the mixing silos disclosed herein use physical phenomena for mixing particulate bulk material and for removing dust that is contained in the mixing material, or is created during the mixing process. Embodiments disclosed herein do not utilize mechanical mixing parts that directly contact the particulate mixing material. Thus, creation of additional dust by contact with moving mechanical mixing parts, or from the friction between moving mechanical mixing parts themselves, is reduced or eliminated.

The apparatus and process disclosed herein include at least the following embodiments:

Embodiment 1

A mixing silo comprising: a mixing chamber having a top and a bottom, and a mixing chamber outlet located at the bottom of the mixing chamber; an inlet hose connected to an inlet opening, located towards the top of the mixing chamber; an outlet hose connected to an outlet opening, located towards the top of the mixing chamber at a point above the inlet hose and inlet opening; a sieve located towards the top of the mixing chamber, disposed above the inlet opening and below the outlet opening, configured to prevent contact between a particulate mixing material and the top of the mixing chamber and to allow dust therethrough; a pump system operably connected to the mixing chamber, configured to create a negative pressure region at the top of the mixing chamber and pull dust through the sieve and remove the sieved dust from the top of the mixing chamber via the outlet opening; and an air manifold assembly, located in the mixing chamber towards the bottom, including an air pressure manifold comprising an air nozzle to introduce an air stream into the mixing chamber, and an air manifold cover configured to allow an air stream into the mixing chamber, to prevent contact between the particulate mixing material and the air pressure manifold, and to allow a particulate mixed product material to pass to the mixing chamber outlet.

Embodiment 2

The mixing silo of Embodiment 1, wherein the inlet hose is flexibly connected to the inlet opening.

Embodiment 3

The mixing silo of any of Embodiments 1-2, wherein the inlet hose is connected to the inlet opening at a downward angle of 35° to 55°.

Embodiment 4

The mixing silo of any of Embodiments 1-3, wherein the inlet hose extends into the mixing chamber and further includes an outlet located below the sieve.

Embodiment 5

The mixing silo of Embodiment 4, wherein the inlet hose extending into the inlet chamber has a spiral configuration.

Embodiment 6

The mixing silo of any of Embodiments 1-5, further including a dust pipe, a dust pipe inlet located below the sieve, and a dust pipe outlet located above the sieve.

Embodiment 7

The mixing silo of Embodiment 6, wherein the dust pipe is configured to support a portion of the inlet hose that extend into the mixing chamber.

Embodiment 8

The mixing silo of any of Embodiments 1-7, wherein the air pressure manifold includes a plurality of air nozzles.

Embodiment 9

The mixing silo of any of Embodiments 1-8, wherein the air pressure manifold is fixedly attached to the mixing chamber.

Embodiment 10

The mixing silo of any of Embodiments 1-8, wherein the air pressure manifold is rotatably attached to the mixing chamber.

Embodiment 11

The mixing silo of Embodiment 10, wherein the air pressure manifold is an air blade further including: a blade rotation mechanism; and a blade spinning motor.

Embodiment 12

The mixing silo of any of Embodiments 1-11, wherein each nozzle is adjustable at an angle theta from 0° to 90°, an angle phi from 0° to 360°, or both.

Embodiment 13

The mixing silo of any of Embodiments 1-12, wherein the mixing silo further includes a load cell.

Embodiment 14

The mixing silo of any of Embodiments 1-13, further including a dust collection unit operably connected to the outlet hose.

Embodiment 15

The mixing silo of any of Embodiments 1-14, further including a silo outlet pipe operably connected to the mixing chamber outlet, and a release mechanism located therebetween, wherein the release mechanism is configured to retain a mixed product material in the mixing silo or release the mixed product material into the silo outlet pipe.

Embodiment 16

A process for mixing a particulate mixing material in a mixing silo, the process comprising: introducing the particulate mixing material into a mixing chamber, the mixing chamber including a top and a bottom, and a mixing chamber outlet located at the bottom of the mixing chamber; introducing an air stream into the mixing chamber to mix the particulate mixing material, wherein the introducing is via an air manifold assembly located towards the bottom of the mixing chamber; creating a negative pressure region at the top of the mixing chamber to pull dust into the negative pressure region, wherein the dust passes through a sieve located at the top of the mixing chamber and the sieve is configured to allow the dust to pass but not the particulate mixing material; removing the dust from the silo; and allowing the mixed product material to accumulate in the mixing chamber outlet. The air manifold assembly includes an air pressure manifold including a nozzle; and an air manifold cover, configured to allow the air stream into the mixing chamber, to prevent contact between the particulate mixing material and contacting the air pressure manifold, and to allow a particulate mixed product material to pass to the mixing chamber outlet.

Embodiment 17

The process of Embodiment 16, further including introducing a plurality of air streams into the mixing chamber, wherein each air stream is independently introduced at the same or different time, or air flow, or air pressure, or direction.

Embodiment 18

The process of Embodiment 17, further including adjusting at least one of the air flow, air pressure, or direction of the air stream during introducing the air stream.

Embodiment 19

The process of any of Embodiments 16-18, wherein the air manifold assembly is in the form of a movable air blade that moves during at a part or the entirety of introducing the air stream.

Embodiment 20

The process of any of Embodiments 16-19, further including removing the dust continuously during the process.

Embodiment 21

The process of any of Embodiments 16-20 including the mixing silo of any of Embodiments 1-15.

In general, the apparatuses and methods can alternatively comprise, include, consist of, or consist essentially of, any appropriate components or steps herein disclosed. The apparatuses and methods can additionally, or alternatively, be formulated so as to be devoid, or substantially free, of any components, materials, ingredients, adjuvants or species that are wise not necessary to the achievement of the function and/or objectives of the present claims.

The endpoints of all ranges directed to the same component or property are inclusive and independently combinable (e.g., ranges of "less than or equal to 25 wt %, or 5 wt % to 20 wt %," is inclusive of the endpoints and all intermediate values of the ranges of "5 wt % to 25 wt %," etc.). Disclosure of a narrower range or more specific group in addition to a broader range is not a disclaimer of the broader range or larger group. "Combination" is inclusive of blends, mixtures, alloys, reaction products, and the like. Furthermore, the terms "first," "second," and the like, herein do not denote any order, quantity, or importance, but rather are used to denote one element from another. The terms "a" and "an" and "the" herein do not denote a limitation of quantity, and are to be construed to cover both the singular and the plural, unless otherwise indicated herein or clearly contradicted by context. "Or" means "and/or." The suffix "(s)" as used herein is intended to include both the singular and the plural of the term that it modifies, thereby including one or more of that term (e.g., the film(s) includes one or more films). Reference throughout the specification to "one embodiment," "another embodiment", "an embodiment," some embodiments," and so forth, means that a particular element (e.g., feature, structure, and/or characteristic) described in connection with the embodiment is included in at least one embodiment described herein, and may or may not be present in other embodiments. In addition, it is to be understood that the described elements can be combined in any suitable manner in the various embodiments.

The terms "front," "back," "bottom," and/or "top" are used herein, unless otherwise noted, merely for convenience of description, and are not limited to any one position or spatial orientation. "Optional" or "optionally" means that the subsequently described event or circumstance can or cannot occur, and that the description includes instances where the event occurs and instances where it does not. Unless defined otherwise, technical and scientific terms used herein have the same meaning as is commonly understood by one of skill in the art to which this invention belongs. A "combination" is inclusive of blends, mixtures, alloys, reaction products, and the like.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

I claim:

1. A mixing silo, comprising:

a mixing chamber having a top and a bottom, and a mixing chamber outlet located at the bottom of the mixing chamber;

an inlet hose connected to an inlet opening, located towards the top of the mixing chamber;

an outlet hose connected to an outlet opening, located towards the top of the mixing chamber at a point above the inlet hose and inlet opening;

a sieve located towards the top of the mixing chamber, disposed above the inlet opening and below the outlet opening, configured to prevent contact between a particulate mixing material and the top of the mixing chamber and to allow dust therethrough;

a dust pipe, a dust pipe inlet located below the sieve, and a dust pipe outlet located above the sieve;

a pump system operably connected to the mixing chamber, configured to create a negative pressure region at the top of the mixing chamber and pull dust through the sieve and remove the sieved dust from the top of the mixing chamber via the outlet opening; and an air manifold assembly, located in the mixing chamber towards the bottom, including an air pressure manifold comprising an air nozzle to introduce an air stream into the mixing chamber, and an air manifold cover configured to allow an air stream into the mixing chamber, to prevent contact between the particulate mixing material and the air pressure manifold, and to allow a particulate mixed product material to pass to the mixing chamber outlet.

2. The mixing silo of claim 1, wherein the inlet hose is flexibly connected to the inlet opening.

3. The mixing silo of claim 1, wherein the inlet hose is connected to the inlet opening at a downward angle of 35° to 55°.

4. The mixing silo of claim 1, wherein the inlet hose extends into the mixing chamber and further includes an outlet located below the sieve.

5. The mixing silo of claim 4, wherein the inlet hose extending into the inlet chamber has a spiral configuration.

6. The mixing silo of claim 1, wherein the dust pipe is configured to support a portion of the inlet hose that extend into the mixing chamber.

7. The mixing silo of claim 1, wherein the air pressure manifold includes a plurality of air nozzles.

8. The mixing silo of claim 1, wherein the air pressure manifold is fixedly attached to the mixing chamber.

9. The mixing silo of claim 1, wherein the air pressure manifold is rotatably attached to the mixing chamber.

10. The mixing silo of claim 9, wherein the air pressure manifold is an air blade further including:

a blade rotation mechanism; and a blade spinning motor.

11. The mixing silo of claim 1, wherein each nozzle is adjustable at an angle theta from 0° to 90°, an angle phi from 0° to 360°, or both.

12. The mixing silo of claim 1, wherein the mixing silo further includes a load cell.

13. The mixing silo of claim 1, further including a dust collection unit operably connected to the outlet hose.

14. The mixing silo of claim 1, further including a silo outlet pipe operably connected to the mixing chamber outlet, and a release mechanism located therebetween, wherein the release mechanism is configured to retain a mixed product material in the mixing silo or release the mixed product material into the silo outlet pipe.

15. A process for mixing a particulate mixing material in a mixing silo, the process comprising:

introducing the particulate mixing material into a mixing chamber, the mixing chamber including a top and a bottom, and a mixing chamber outlet located at the bottom of the mixing chamber;

introducing an air stream into the mixing chamber to mix the particulate mixing material, wherein the introducing is via an air manifold assembly located towards the bottom of the mixing chamber, the air manifold assembly including:

an air pressure manifold including a nozzle; and an air manifold cover, configured to allow the air stream into the mixing chamber, to prevent contact between the particulate mixing material and contacting the air pressure manifold, and to allow a particulate mixed product material to pass to the mixing chamber outlet;

creating a negative pressure region at the top of the mixing chamber to pull dust into the negative pressure region, wherein the dust passes through a sieve located at the top of the mixing chamber and the sieve is configured to allow the dust to pass but not the particulate mixing material, wherein the mixing silo includes a dust pipe, a dust pipe inlet located below the sieve, and a dust pipe outlet located above the sieve;

removing the dust from the silo; and allowing the mixed product material to accumulate in the mixing chamber outlet.

16. The process of claim 15, further including introducing a plurality of air streams into the mixing chamber, wherein each air stream is independently introduced at the same or different time, or air flow, or air pressure, or direction.

17. The process of claim 16, further including adjusting at least one of the air flow, air pressure, or direction of the air stream during introducing the air stream.

18. The process of claim 15, wherein the air manifold assembly is in the form of a movable air blade that moves during at a part or the entirety of introducing the air stream.

* * * * *